US005454326A

United States Patent [19]

Goirand

[11] Patent Number: 5,454,326

[45] Date of Patent: Oct. 3, 1995

[54] CHAIRLIFT WITH CONVEYOR LOADING

[75] Inventor: Bernard Goirand, Sassenage, France

[73] Assignee: Pomagalski S.A., France

[21] Appl. No.: 202,009

[22] Filed: Feb. 25, 1994

[30] Foreign Application Priority Data

Mar. 5, 1993 [FR] France ..... 93 02776

[51] Int. Cl.[6] ..... B61B 1/00

[52] U.S. Cl. ..... 104/28; 104/173.1

[58] Field of Search ..... 104/173.1, 173.2, 104/178, 179, 27, 28

[56] References Cited

U.S. PATENT DOCUMENTS

| | | | |
|---|---|---|---|
| 3,548,753 | 12/1970 | Thurston | 104/173.2 |
| 3,602,361 | 8/1971 | Cheronis | 104/173.2 |
| 3,981,248 | 9/1976 | Savage | 104/173.2 |
| 4,223,609 | 9/1980 | Montagner | 104/173.2 |
| 4,662,285 | 5/1987 | Rossignol | 104/28 |

FOREIGN PATENT DOCUMENTS

| | | | |
|---|---|---|---|
| 0277315 | 12/1969 | Austria | 104/173.2 |
| 392617 | 5/1991 | Austria . | |
| 0287868 | 10/1988 | European Pat. Off. | 104/173.2 |
| 0430091 | 11/1990 | European Pat. Off. . | |
| 1451552 | 7/1966 | France | 104/173.2 |
| 0132466 | 6/1991 | Japan | 104/173.2 |

*Primary Examiner*—Mark T. Le
*Attorney, Agent, or Firm*—Parkhurst, Wendel & Rossi

[57] ABSTRACT

A fixed grip chairlift comprises a continuously moving conveyor belt for transporting the skiers to the loading point where they are met by a chair which moves at a higher speed. The chair impact is thus reduced and the chairlift speed may be increased. A gate is disposed at the entrance of the conveyor belt to control the access. A loading cycle is started by the passage of a chair at a predetermined point. The gate is opened so that the skiers may step onto the conveyor belt and are transported to the loading point where they are caught by the chair which has started the cycle.

6 Claims, 1 Drawing Sheet

CHAIRLIFT WITH CONVEYOR LOADING

BACKGROUND OF THE INVENTION

The invention relates to an installation for loading skiers on a chairlift having a continuously moving cable and chairs coupled to the cable by fixed grips.

Since the chair moves relatively rapidly along the loading area, the skiers have some difficulties to sit down properly. In detachable grip chairlifts, the chairs are stopped or moved at slow speed at the loading point, but such chairlifts are complicated and more expensive.

It has already been proposed to provide under the drive sheave a slight slope in the centreline of the cable, on which the skiers move towards the loading point, where they are taken over by the chair which arrives from behind them. The start of the skiers is controlled by light signals or barriers but the skiers speed changes with the snow conditions and the skiers capabilities.

In U.S. Pat. No. 3,548,753 is disclosed a passenger loading installation having a conveyor by means of which the passengers are accelerated to a velocity substantially the same as that of the cable. After embarkment of the passengers the conveyor is stopped and the next passengers may step on the conveyor to be moved towards the loading point. The synchronization between the motions of the conveyor and the arrival of the chairs requires complicated control systems and the time necessary to accelerate and thereafter to stop the conveyor limits the transport capacity of the chairlift. The skiers can step on the conveyor only after the embarkment of the preceding skiers and the stopping of the conveyor.

Another loading system comprises a conveyor continuously moving at a speed less than the speed of the cable in order to transport the skiers at the loading point, where the skiers can sit down on the chair which arrives at the same time. The access to the conveyor is controlled by a gate, which is opened periodically in accordance with the passage of the chairs as soon as the preceding chair has crossed the conveyor. Such a system requires a perfect regular spacing of the chairs along the cable and an adjustment when the cable length changes to prevent arrival of skiers at the conveyor end before being taken over by the chair, or collision of the chair and the skiers.

The object of the present invention is to provide a loading system which improves the safety of the loading and at the same time the loading rate and transport capacity of the chairlift.

SUMMARY OF THE INVENTION

The present invention achieves this object by providing a continuously moving conveyor belt, at a speed less than the cable speed for carrying skiers to the loading point and a gate for controlling the stepping onto the conveyor belt of the skiers, the opening of the gate being controlled by a chair passage detector located adjacent the downhill path of the chairlift and adapted to open the gate at the passage of the chair so that the skiers stepping onto the conveyor belt are caught up at the loading point by the chair having actuated the passage detector. The length of time necessary for the chair to travel from the chair passage detector position to the loading point is independent from the chair spacing, as well as the length of time necessary for the skiers stepping onto the conveyor to arrive at the loading point and to the chair catches up the skiers always at the same point. These lengths of time change with the cable speed and the conveyor belt speed, the conveyor speed being advantageously adapted to the cable speed. A control unit is also provided to adjust automatically the conveyor speed to the cable speed, for instance between one-half and one-third of the cable speed. This control unit includes a time delay relay which can delay the gate opening signal emitted by the chair passage detector and this time delay may be manually adjusted, for instance to compensate cable length variations or shifting of the detector.

The chair passage detector is advantageously secured to the cable support tower located at the terminal entrance and the gate is a barrier at the entrance of the conveyor belt, which is operated by the control unit to open a short time to admit the approaching skiers. It will be evident that the gate holds back the skiers until the preceding chair has cleared the loading area and the succeeding chair has not yet crossed the conveyor. When the loading system comprises a short slope located before the conveyor belt the gate is located before this slope.

Other objects and advantages of the invention will appear from a description of a preferred form thereof.

BRIEF DESCRIPTION OF THE DRAWING

In the drawing the figure is a schematic plan view of a loading system of a chairlift according to the invention.

DESCRIPTION OF THE PREFERRED EMBODIMENT

Figure 1:
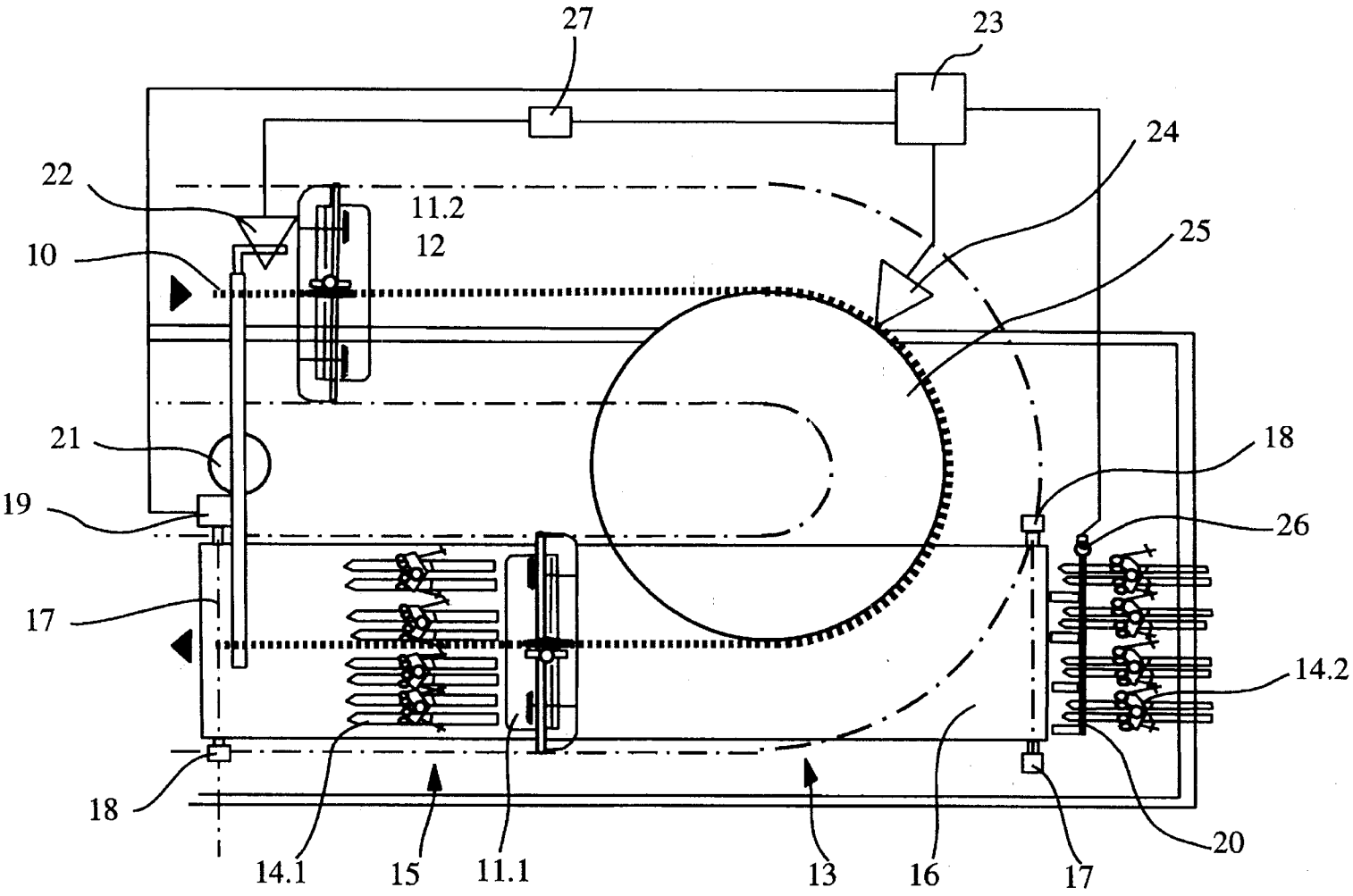

In the figure, an overhead continuous moving cable 10 of a single cable chairlift extends between two terminals and runs in each terminal on a return pulley 25, one of which being driven in rotation by a motor. Chairs 11, for instance for four passengers, are coupled to the cable 10 by fixed grips 12 regularly spaced. At the exit of the pulley 25 the chairs 11 pass along a loading area 13 to catch up to the skiers 14 at a predetermined loading point 15. The skiers arrive from the rear of the terminal, in the centreline of the uphill cable path and move under the pulley 25 towards the loading point 15. Such chairlifts are well known.

According to the present invention, the loading area 13 is equiped with a conveyor, constituted by an endless belt 16 extending between two end drums 17 each having a horizontal axis rotatably mounted in bearings 18. One of these drums 17 is driven in rotation by a motor 19 and the width of the conveyor belt 16 corresponds to the width of the chair 11. The conveyor belt 16 is colinear with the cable 10 in the loading area 13. At the entrance of the conveyor belt 16 and outside the travel path of the chairs, represented by a dash-dot line, is located a gate 20, for instance a signal light or a barrier extending across the entrance. The gate 20 is actuated by a motor 26 and the opening of the gate 20 allows the skiers to step onto the conveyor belt 16, which runs at a speed less than the cable 10 speed. The surface of the conveyor belt 16 has a high slipping coefficient relative to the sole of the ski to limit the shock at the instant of stepping on the belt 16. This shock may be limited by a short launching slope located before the conveyor belt 16, so that the skiers glid at the end of the slope substantially at the same speed as the conveyor belt 16. In that case the gate 20 is located at the entrance of the slope.

A cable 10 support tower 21 is located at the entrance of the terminal and a chair passage detector 22 is rigidly secured to the tower 21, adjacent to the down hill path of the cable 10 so as to emit a signal at each passage of a chair 11. The detector 22 is connected to a central control unit 23 which controls the chairlift operation or at least the loading system with the conveyor belt 16. The chair passage detector 22 may be an electrical contact actuated by the chair passing along the detector. A cable speed detector 24 cooperates with the pulley 25 to emit a speed signal transmitted to the control unit 23. The control unit 23 controls the speed of the conveyor belt 16 and the opening of gate 20.

The loading system functions as follows:

At the instant shown on the figure, a group of skiers 14.1 standing on the conveyor belt 16, arrive at the loading point 15 and are caught by the chair 11.1 which moves at a higher speed than the conveyor belt 16. The relative speed of the chair 11.1 to the skiers is however limited and the skiers can embark properly. The conveyor belt 16 speed is adjusted by the control unit 23 automatically to cable 10 speed.

The following chair 11.2 has actuated at its passage the chair passage detector 22 and the control unit 23 has just ordered the opening of gate 20. The skiers 14.2 waiting at the gate 20 move forward to step onto the conveyor belt 16, which transports the skiers 14.2 towards the loading point 15 where chair 11.2 catches up to skiers 14.2, chair 11.2 having ordered the gate 20 opening. The conveyor belt 16 is substantially horizontal and the skiers standing on the conveyor belt remain stationary thereon, so that the time interval during which the skiers are transported by the conveyor belt 16, between stepping onto the conveyor belt 16 and meeting the chair, is only determined by the conveyor belt speed and the conveyor belt length. This time interval should correspond to the length of time necessary for the chair 11 to travel from the chair passage detector 22 to the loading point 15. The chair passage detector 22 may be shifted accordingly but it is easier to provide a time delay relay 27 which delays the signal of the chair passage detector 22 transmitted to the control unit 23. The time delay may be manually adjusted so that the skiers 14 and the chair 11 arrive at the loading point 15 at the same instant. The chair passage detector 22 is secured to a fixed part for instance to the entrance tower 21 of the terminal. The time delay relay 27 allows a manual or automatic adjustement in accordance with the speed of the cable 10 and/or the length variations of this cable 10.

It should be noted that a loading cycle starts with the passage of the chair on which the skiers will be seated and this cycle is not modified by the chair spacing. The control unit 23 closes the gate 20 before the chair 11 crosses the conveyor belt 18 to prevent any collision.

To limit shocks at the instant of stepping onto the conveyor belt 16, the surface material of the belt may provide easy gliding. A slight slope may be located before the conveyor belt 16 to accelerate the skiers through gravitation before they step onto the conveyor belt 16. In that case the gate 20 is located at the entrance of the slope.

What is claimed is:

1. A chairlift comprising:

an endless overhead cable extending between two terminals, one of the two terminals having a skier loading area;

a plurality of chairs including a first chair, each coupled to the cable via a fixed grip;

a conveyor belt extending parallel to the cable along the skier loading area for carrying skiers to a loading position;

a driver for driving the conveyor belt at a speed less than a speed of the cable;

a gate at an entrance of the conveyor belt; and actuation means for opening the gate by the first chair, prior to said first chair passing the gate, whereby the skiers are transported on the conveyor belt from the gate after opening to the loading position to load onto the first chair, said actuation means comprising a chair passage detector and an adjustable delay relay for delaying opening of the gate upon passage of the first chair by the chair passage detector.

2. The chairlift of claim 1, further comprising a cable support tower positioned at an entrance of said one of the two terminals, said chair passage detector being secured to the tower and said time delay relay being set with respect to a distance between the tower and the conveyor belt.

3. The chairlift of claim 1, further including a slope provided between the gate and the conveyor belt.

4. The chairlift of claim 1, further comprising a cable speed detector connected to a control unit for controlling a speed of the conveyor belt via the driver, such that the skiers reach the loading position concurrently with the first chair.

5. The chairlift of claim 1, wherein a delay of the time delay relay is automatically set with respect to the speed of the cable.

6. The chairlift of claim 1, wherein a delay of the time delay relay is automatically set with respect to a variation in length of the cable.

* * * * *